US010021928B2

(12) United States Patent
Szcepanowski et al.

(10) Patent No.: US 10,021,928 B2
(45) Date of Patent: Jul. 17, 2018

(54) FIGURE ENHANCING GARMENT

(71) Applicant: Everything Lidia, Incorporated, Commack, NY (US)

(72) Inventors: Lidia Szcepanowski, Dix Hills, NY (US); Steve Berenson, Miami Beach, FL (US)

(73) Assignee: EVERYTHING LIDIA INCORPORATED, Commack, NY (US)

( * ) Notice: Subject to any disclaimer, the term of this patent is extended or adjusted under 35 U.S.C. 154(b) by 21 days.

(21) Appl. No.: 15/060,012

(22) Filed: Mar. 3, 2016

(65) Prior Publication Data

US 2016/0255889 A1 Sep. 8, 2016

Related U.S. Application Data

(60) Provisional application No. 62/128,543, filed on Mar. 5, 2015.

(51) Int. Cl.

| | |
|---|---|
| ***A41D 27/00*** | (2006.01) |
| ***A41D 27/26*** | (2006.01) |
| ***A41D 1/22*** | (2018.01) |
| *A41B 9/06* | (2006.01) |
| *A41B 9/08* | (2006.01) |

(52) U.S. Cl.

CPC ..... *A41D 27/26* (2013.01); *A41D 1/22* (2013.01); *A41B 9/06* (2013.01); *A41B 9/08* (2013.01); *A41B 2400/38* (2013.01); *A41D 2400/38* (2013.01)

(58) Field of Classification Search

CPC ..... A41D 27/26; A41D 1/22; A41D 2400/38; A41C 3/0035; A41C 3/08

USPC ..... 2/74, 152.1; 450/7, 11

See application file for complete search history.

(56) References Cited

U.S. PATENT DOCUMENTS

| | | | | | |
|---|---|---|---|---|---|
| 2,332,141 | A | * | 10/1943 | Greene | A41C 1/00 2/267 |
| 2,516,426 | A | * | 7/1950 | Schimmel | A41C 3/06 2/74 |
| 2,863,460 | A | * | 12/1958 | Monroe | A41C 3/08 450/11 |
| 3,066,307 | A | * | 12/1962 | Loewe | A41D 13/04 2/48 |
| 3,295,530 | A | * | 1/1967 | Mayer | A41C 1/003 450/104 |
| 3,678,514 | A | | 7/1972 | Safrit | |
| 3,765,095 | A | * | 10/1973 | Olive | A41H 3/04 33/14 |
| 4,699,144 | A | * | 10/1987 | Sherwood | A41C 3/148 450/54 |
| 5,065,458 | A | | 11/1991 | Johnson | |
| 5,784,723 | A | | 7/1998 | Noble et al. | |

(Continued)

*Primary Examiner* — Khaled Annis

(74) *Attorney, Agent, or Firm* — Hoffmann & Baron, LLP

(57) ABSTRACT

A combination garment with figure enhancing devices provided on the garment itself. The garment, for example a dress, includes an outer dress and a liner made of a four-way stretch material attached to the outer dress. Preferably, the liner is attached to the outer dress only at the arm holes. Otherwise, the liner hangs completely free from the outer dress. The liner includes a w-shaped pocket on a front side adapted to receive bust pads and a u-shaped pocket on a rear side adapted to receive buttocks pads.

16 Claims, 6 Drawing Sheets

(56) References Cited

U.S. PATENT DOCUMENTS

| | | | | |
|---|---|---|---|---|
| 5,842,232 | A * | 12/1998 | Parrish | A41B 9/001 2/267 |
| 5,915,531 | A | 6/1999 | Hilpert et al. | |
| 5,996,120 | A * | 12/1999 | Balit | A41B 17/00 2/243.1 |
| 6,205,591 | B1 | 3/2001 | Wheeler et al. | |
| 6,892,399 | B1 | 5/2005 | Rocha | |
| 2002/0031978 | A1* | 3/2002 | Heroff | A41C 3/08 450/30 |
| 2008/0229474 | A1* | 9/2008 | Fons | A41B 9/08 2/113 |
| 2008/0244805 | A1 | 10/2008 | Griffin | |
| 2009/0031469 | A1 | 2/2009 | Christensen et al. | |
| 2011/0209262 | A1* | 9/2011 | Waldman | A41D 27/02 2/67 |
| 2011/0214216 | A1* | 9/2011 | Zarabi | A41D 27/02 2/69 |
| 2011/0225696 | A1* | 9/2011 | Di Lorenzo | A41D 7/00 2/67 |
| 2012/0129425 | A1* | 5/2012 | Bevans | A41D 1/06 450/11 |
| 2014/0273734 | A1* | 9/2014 | Gordon | A41C 1/06 450/7 |
| 2014/0310854 | A1* | 10/2014 | Kianmahd | A41D 1/06 2/237 |
| 2015/0038049 | A1* | 2/2015 | Kwak | A41C 1/06 450/7 |
| 2015/0044943 | A1* | 2/2015 | Marshall | A41C 3/005 450/93 |
| 2015/0208734 | A1* | 7/2015 | Callahan | A41C 3/08 450/30 |

* cited by examiner

FIGURE ENHANCING GARMENT

This application claims priority to U.S. Provisional Application Ser. No. 62/128,543 filed on Mar. 5, 2015, the disclosure of which is incorporated herein by reference in its entirety.

FIELD OF THE INVENTION

The present invention relates generally to a figure enhancing garment and more particularly, to a dress which includes a four-way stretch liner and having built-in pockets to receive figure enhancing pads in the bust and buttocks region of the garment.

BACKGROUND

Individuals, and particularly women, are oftentimes unhappy with their appearance. For example, a garment may not fit properly in the bust or buttocks region. Thus, the person may want to enhance those areas through the use of padded undergarments or the like. Such undergarments have various limitations. A typical figure enhancing undergarment provides an extra layer of clothing which may be undesirable to the wearer. Furthermore, such figure enhancing undergarments may include edges which are visible beneath the outer clothing creating undesirable "panty lines." Additionally, many of today's styles of garments, and particularly dresses are designed to be tight fitting. A tight fitting outer garment requires undergarments which must be carefully chosen so as not to be visible beneath the outer garment.

Thus, there is a need for a figure enhancing garment that is comfortable, enhances the wearer's figure, does not reveal the use of enhancing undergarments and adds desired shape to the wearer's bust and buttocks region.

SUMMARY

The present invention is a combination garment and figure enhancing device which includes an outer dress having arm holes and an inner liner attached to the outer dress only at the arm holes, the inner liner being formed from a four-way stretch material. The liner preferably includes a w-shaped pocket provided in a bust region of the dress. The w-shaped pocket is adapted to receive a pair of bust enhancing pads. In the preferred embodiment, the w-shaped pocket is attached to the liner by a flat seam provided outside the pocket and which lies against the body of a wearer. The w-shaped pocket also includes a center seam formed using an elastic thread which gathers the pocket material along the seam to create a pair of individual pad receiving pockets. The w-shaped pocket is preferably made from a mesh material which is also stretchable and soft against the wearer's skin.

The combination garment and figure enhancing device of the present invention preferably also includes a u-shaped pocket provided in a buttocks region of the dress. The u-shaped pocket is adapted to receive a pair of buttocks enhancing pads. Likewise, the u-shaped pocket is attached to the liner by a flat seam provided outside the pocket and which lies against the body of the wearer. The u-shaped pocket is made from a four-way stretch material, i.e., the same material as the liner.

DETAILED DESCRIPTION

Figure 1:
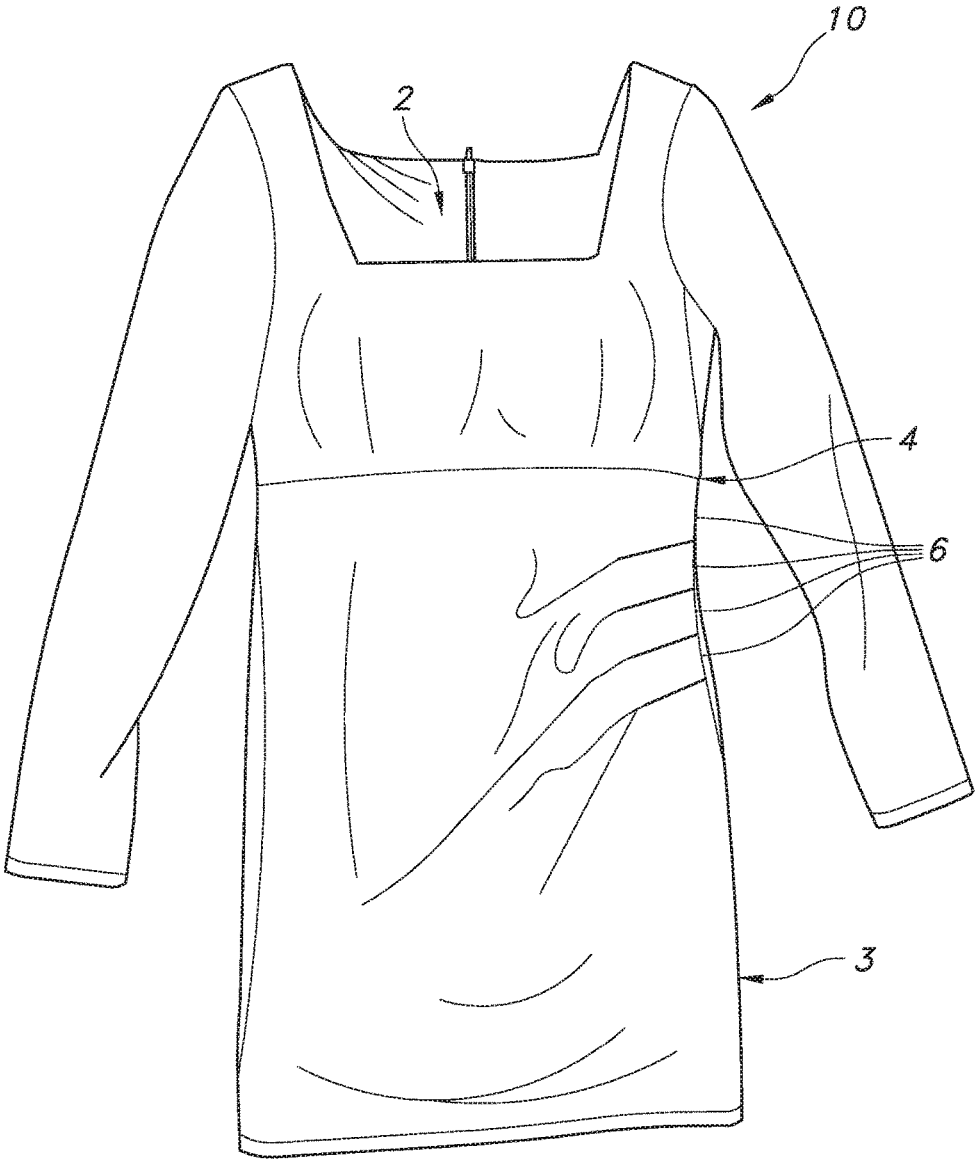
FIG. 1 is a front view of the figure enhancing garment formed in accordance with the present invention.

A shown in FIG. 1, the figure enhancing garment of the present invention is illustrated as a woman's dress 10. Although the invention is depicted in the figures as a dress, the inventive concepts disclosed herein may be equally applicable to individual tops and bottoms, such as a blouse and skirt. The dress 10 formed in accordance with the present invention as shown in FIG. 1 includes a square neckline 2 and long sleeves; however, any neckline, such as a v-neck, scoop neck or even a turtleneck may be used. Likewise, the dress 10 may be made with short sleeves, cap sleeves or no sleeves at all. Preferably, the dress 10 includes an empire waist 4, i.e., a waist line just below the bust line, although other waist lines may be used depending upon the garment design. The empire waist seam below the bust line emphasizes the bust enhancing portion of the dress.

As shown in FIG. 1, the dress 10 includes a plurality of pleats 6 on one side only. In the embodiment shown in FIG. 1, the dress 10 includes four (4) pleats formed by four seams which extend downward and inward from the side seam of the dress towards the middle of the front panel below the empire waist. The pleats 6 are preferably stitched down and extend from about 2 to 4 inches from the side seam. The pleats 6 add to the figure enhancing garment by creating an area to enhance the appearance of the wearer's mid-section. FIG. 1 only shows the front outer portion of the dress 10.

Figure 2:
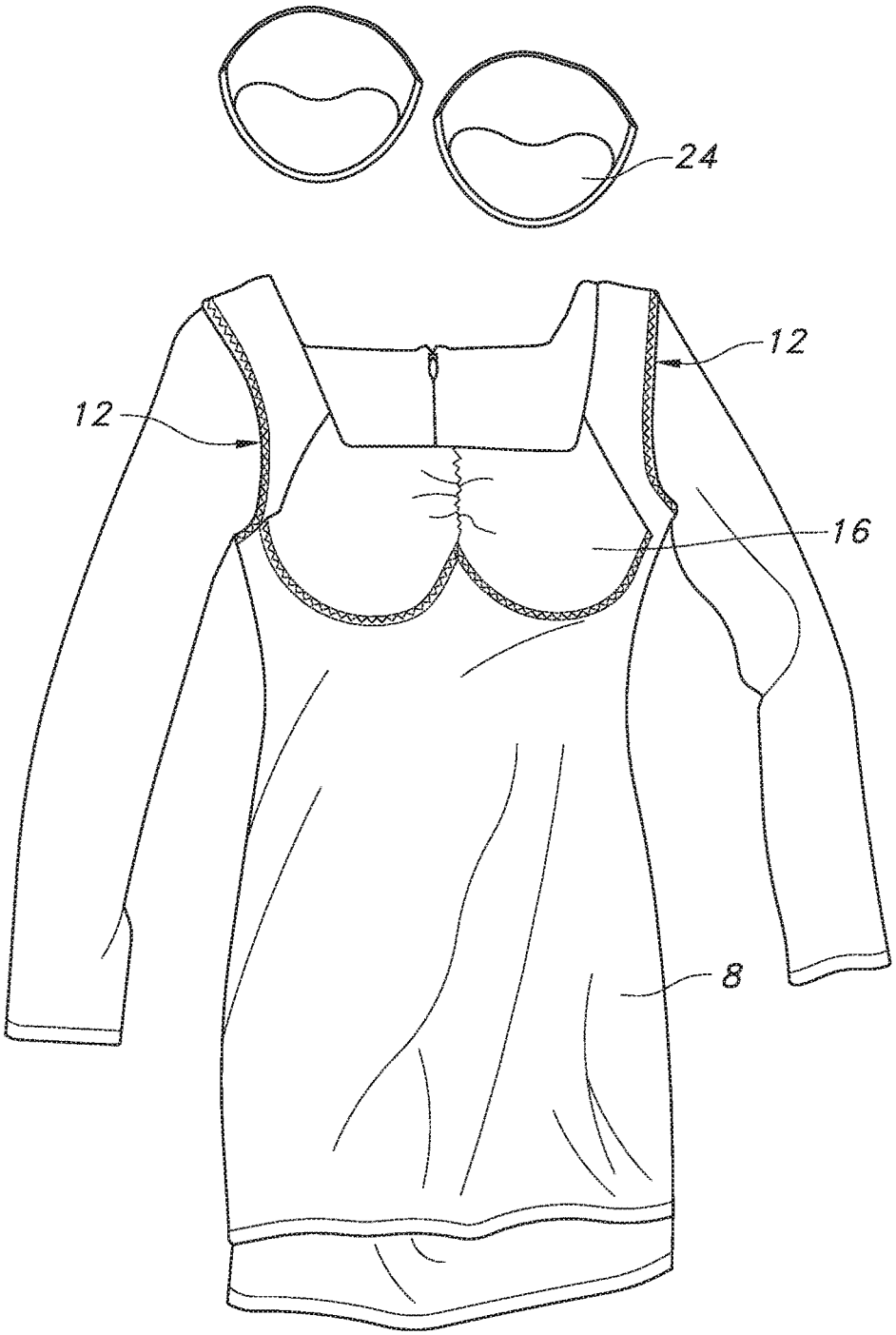
FIG. 2 is a front view of the figure enhancing garment of FIG. 1 turned inside out to show the liner and bust enhancing region of the garment with the bust pads shown outside of the receiving pockets.

As shown in FIG. 2, the dress 10 includes a liner 8 made from a four-way stretch material. The liner 8 is preferably smaller than the outer portion 3 or "self" portion of the dress to tightly fit against the wearer and provide a smooth appearance for the outer dress 3. The liner 8 made of the four-way stretch material also provides support and control for the wearer of the dress similar to an undergarment made of, for example, spandex. However, the liner 8 forms an integral part of the dress 10 and additional undergarments may not be desired or needed. Since the liner 8 is made of a smooth, four-way stretch fabric, it is not visible from the outside of the dress. Furthermore, the liner 8 is only attached to the outer dress at the arm holes 12 and along the zipper 14 provided on the back. If a zipper is not necessary, the liner 8 will only be attached to the outer dress at the arm holes. The liner 8 is not sewn into the side seams of the outer dress 3. Thus, the liner 8 hangs completely free the outer dress 3.

Figure 3:
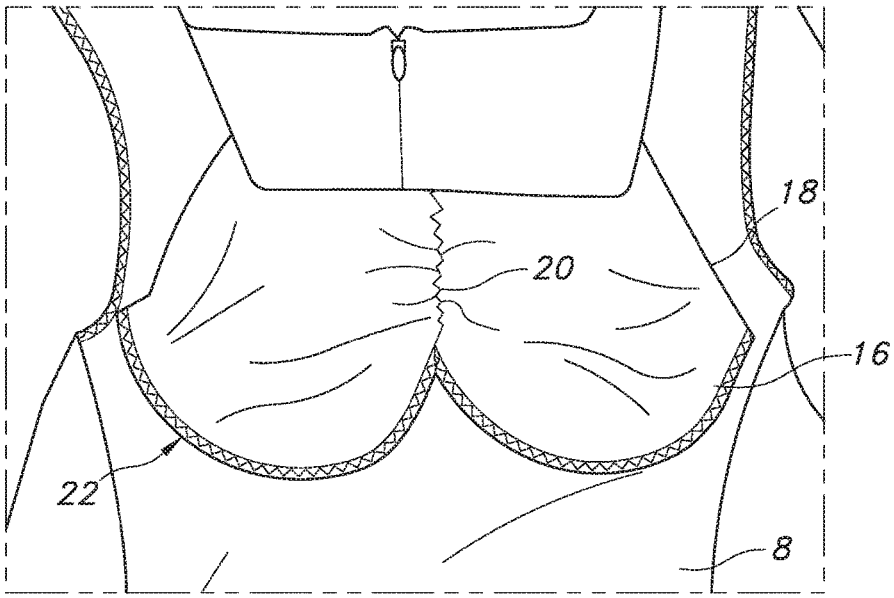
FIG. 3 is an enlarged view of the pockets for the bust enhancing region of the figure enhancing dress as shown in FIG. 2.

Referring to FIGS. 2 and 3, mounted to the liner 8 is a pocket 16 designed to receive bust pads to enhance the wearer's figure. The pocket 16 is preferably made of a light, stretch mesh material having an opening 18 at each side to receive a bust pad. The pocket 16 is only attached to the liner 8 and is preferably a w-shaped pocket adapted to receive a bust pad on each side of the pocket. The pocket 16 is initially formed as a single pocket and is subsequently separated into two distinct pockets by sewing a clear elastic thread at a gathering point 20 in the middle of the pocket. The elastic thread is typically used for bathing suits, not in sportswear or for dresses and provides a unique way of creating the pockets directly within the dress liner 8.

Figure 4:
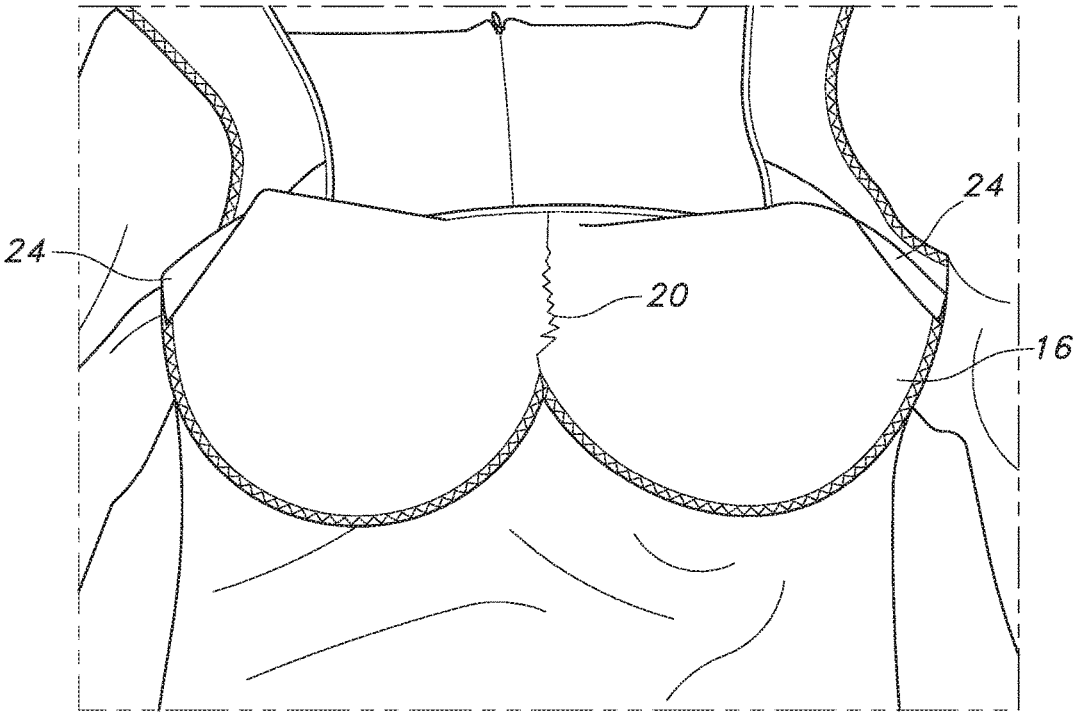
FIG. 4 is an enlarged view of the pocket as shown in FIG. 2 with the bust pads positioned inside the pockets.

The attachment method for the pocket 16 to the liner 8 is also unique. Rather than hide the seam within the pocket as is typically done, the seam is flipped in the opposite way so that the edge of the seam 22 is provided outside the pocket and lies against the body of the wearer. By flipping the seam 22 in this manner, the seam lies flat against the wearer and provides a smooth appearance to the outer dress 3. Accordingly, the flipped seams used on the liner 8 are not visible on the outer dress which is an important feature of the garment formed in accordance with the present invention. The w-shaped pocket seam also runs up and terminates at the arm holes 12, similar to the liner 8. As shown in FIG. 3, the liner 8 is sewn to the arm holes with the same flipped seam as that used for attaching the pocket 16 to the liner 8. FIG. 4 illustrates the pocket 16 having bust pads 24 positioned within the pockets. As shown in FIG. 1, even before the dress is worn, the bust area is enhanced by the bust pads.

Figure 5:
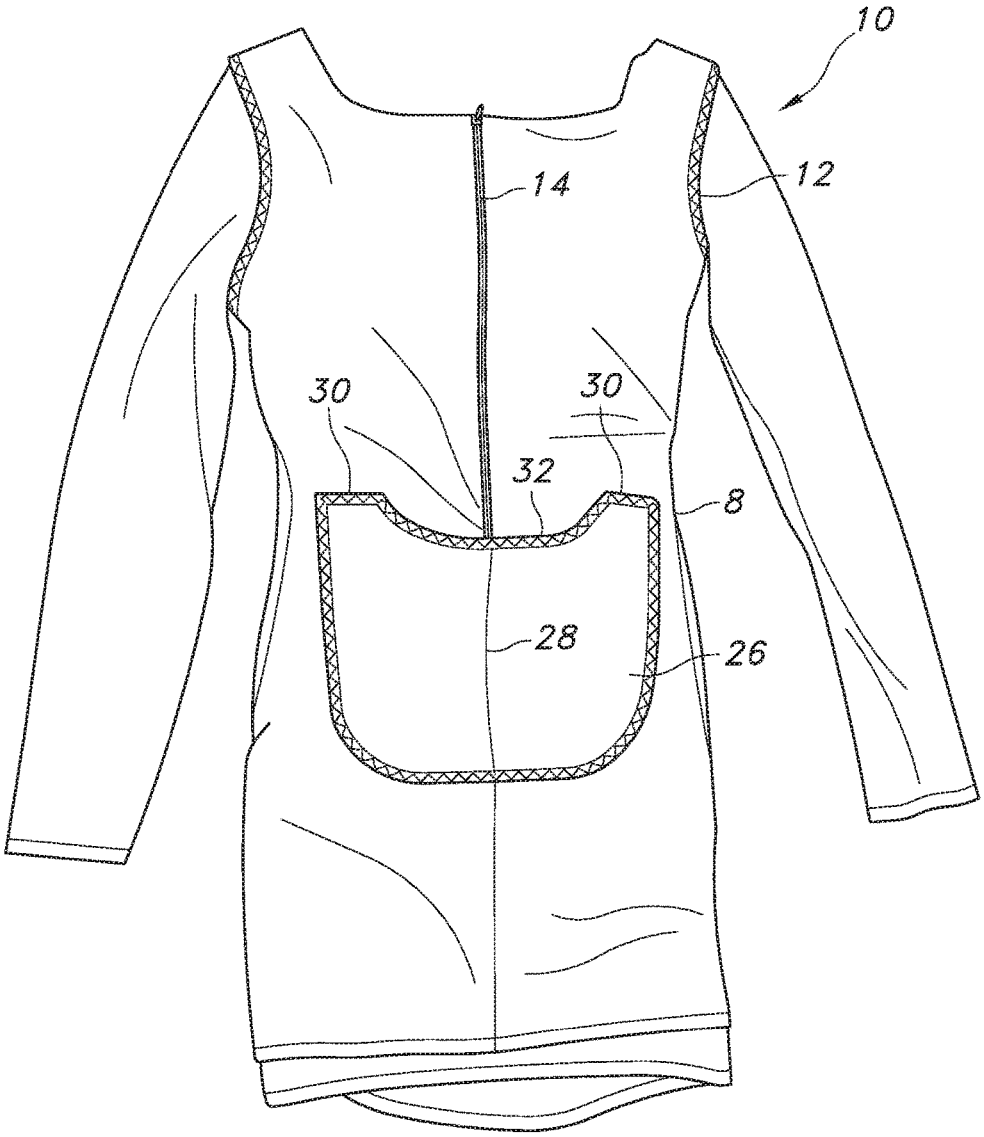
FIG. 5 is a back view of the liner of the figure enhancing garment of FIG. 2 showing the buttocks enhancing region of the garment.
Figure 6:
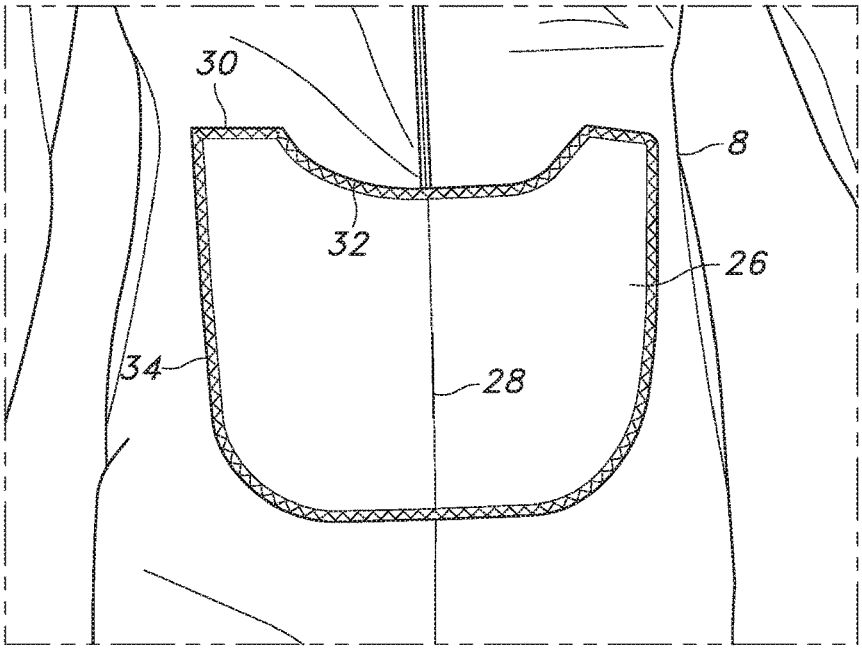
FIG. 6 is an enlarged view of the buttocks enhancing region of the figure enhancing dress as shown in FIG. 5.

FIG. 5 is a back view of the figure enhancing dress shown in FIG. 2 illustrating the liner 8 attached to the outer dress 3 at the arm holes 12 and at the zipper 14. FIGS. 5 and 6 also illustrate the buttocks enhancing region of the dress 10. Specifically, to enhance the buttocks region, the back of the liner is provided with a u-shaped pocket 26 adapted to receive a pair of buttocks enhancing pads. The u-shaped pocket 26 is initially a single pocket which is subsequently separated by a center seam 28 to form a pair of pockets. As clearly seen in FIG. 6, the u-shaped pocket 26 includes a straight seam 30 extending from the top of each side of the "u" towards the center of the liner for a distance of approximately 1½ to 2½ inches. The remainder of the top of the pocket is open and is preferably curved to be concave 32 and extending between the upper straight seams 30 and is open to allow buttocks pads to be placed into the pockets.

Figure 7:
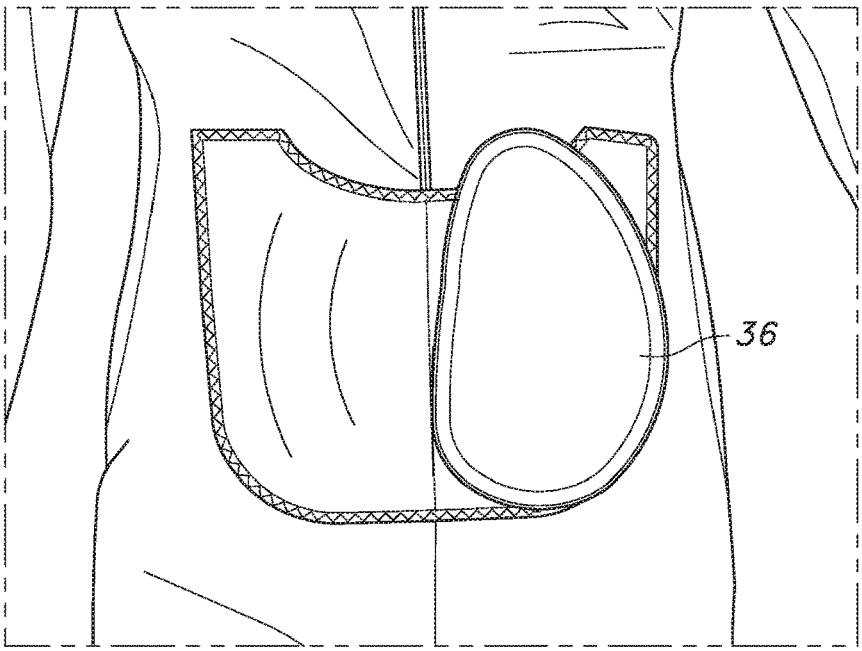
FIG. 7 is an enlarged view as shown in FIG. 6 with one buttock pad shown inside the pocket and one shown outside the pocket.
Figure 8:
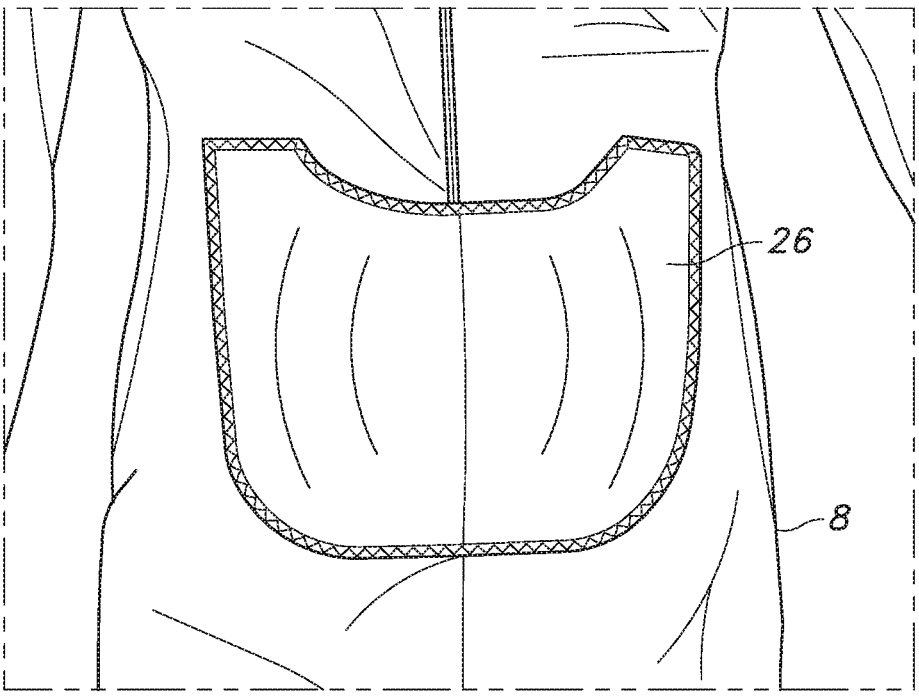
FIG. 8 is an enlarged view as shown in FIG. 6 with both buttocks pads shown in the pockets.

The u-shaped pocket 26 is preferably made of the same four-way stretch material as the liner 8. Alternatively, the u-shaped pocket may be made of the mesh material used to make the bust enhancing w-shaped pocket 16. Similar to the w-shaped pocket, the seam for attaching the u-shaped pocket to the liner 34 is flipped so that the seam is provided outside the pocket and lies flat against the body of the wearer. The seams allow the pocket to be flat and not noticeable when the dress 10 is worn. FIG. 7 is an enlarged view of the u-shaped pocket 26 with one pad 36 outside the pocket and the other pad placed in the pocket. FIG. 8 illustrates the u-shaped pocket 26 with both pads provided within the u-shaped pocket.

As shown in the figures and described above, the figure enhancing dress of the present invention provides a four-way stretchable liner having pockets for receiving enhancing pads in both the bust and buttocks region. The figure enhancing dress eliminates the need for additional undergarments to enhance one's figure since the enhancement areas are provided within the dress itself. Thus, the combination garment which includes the outer dress and attached liner as described above makes enhancing one's figure easy to accomplish.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. A combination garment and figure enhancing device, comprising:

an outer dress; and an inner liner attached to the outer dress having a bust region adapted to be adjacent to a bust area of a wearer when worn, the inner liner being formed from a four-way stretch material, wherein the liner includes a separate w-shaped material attached only to the liner by a seam to form a pocket provided in the bust region of the outer dress, the pocket including separate side-by-side receptacles each having an opening for receiving a bust enhancing pad between the liner and w-shaped material; wherein the separate W-shaped material is unattached to the outer dress;

Wherein the outer dress includes arm holes and a zipper on a back portion, and wherein the liner is attached to the outer dress only at the arm holes and along the zipper.

2. The combination garment and figure enhancing device of claim 1, wherein the pocket is attached to the liner by a flat seam provided outside the pocket and which flat seam lies against a wearer.

3. The combination garment and figure enhancing device of claim 2, wherein the pocket includes an elastic thread center seam extending from the pocket seam up to a neckline of the liner to gather the pocket material at the center thereof and to separate the side-by side receptacles.

4. The combination garment and figure enhancing device of claim 1, wherein the w-shaped material is made from a stretchable mesh material.

5. The combination garment and figure enhancing device of claim 1, wherein the liner further includes a separate u-shaped material attached only to the liner by a seam to form a second pocket provided in a buttocks region of the dress, the second pocket adapted to receive a pair of buttocks enhancing pads.

6. The combination garment and figure enhancing device of claim 5, wherein the u-shaped material is attached to the liner by a flat seam provided outside the pocket and which is adapted to lie against a wearer.

7. The combination garment and figure enhancing device of claim 6, wherein the u-shaped material is made from a four-way stretch material and includes a center seam to form two pockets separated by the center seam and having an opening at a top portion of each pocket.

8. The combination garment and figure enhancing device of claim 5, wherein the separate w-shaped material and separate u-shaped material are attached only to the liner by a flat seam provided outside the pockets and which is adapted to lie against a wearer.

9. The combination garment and figure enhancing device of claim 1, further including a zipper on a back portion thereof and further wherein the liner is attached to both sides of a zipper seam.

10. The combination garment and figure enhancing device of claim 1, wherein the inner liner is smaller in size than the outer dress so that the inner liner fits tightly against a wearer.

11. The combination garment and figure enhancing device of claim 1, wherein the outer dress includes an empire waist and a plurality of pleats on only one side below the empire waist.

12. A combination garment and figure enhancing device, comprising:

an outer blouse having a bust region adapted to be adjacent to a bust area of a wearer when worn; and an inner liner attached to the outer blouse, the inner liner being formed from a four-way stretch material, wherein the liner includes a separate w-shaped material attached only to the liner by a seam to form a pocket provided in the bust region of the outer blouse, the pocket including separate side-by-side receptacles each having an opening to receive bust enhancing pad; wherein the separate W-shaped material is unattached to the outer dress;

Wherein the outer dress includes arm holes and a zipper on a back portion, and wherein the liner is attached to the outer dress only at the arm holes and along the zipper.

13. The combination garment and figure enhancing device of claim 12, wherein the w-shaped material is attached to the liner by a flat seam provided outside the pocket and which is adapted to lie against a wearer.

14. The combination garment and figure enhancing device of claim 12, wherein the pocket includes an elastic thread center seam extending from the pocket seam up to a neckline of the liner to gather the material at the center thereof and to form two separate pockets.

15. The combination garment and figure enhancing device of claim 12, wherein the w-shaped material is made from a stretchable mesh material.

16. The combination garment and figure enhancing device of claim 12, wherein the inner liner is smaller in size than the outer blouse so that the inner liner fits tightly against a wearer.

* * * * *